United States Patent [19]

Thomas

[11] Patent Number: 4,576,374

[45] Date of Patent: Mar. 18, 1986

[54] ROCKING HORSE WITH INTERCONNECTED ROCKERS

[76] Inventor: Gary M. Thomas, 1513 Bob Smith, El Paso, Tex. 79936

[21] Appl. No.: 641,700

[22] Filed: Aug. 17, 1984

[51] Int. Cl.[4] ..... A63G 13/06

[52] U.S. Cl. ..... 272/52.5; 280/1.177

[58] Field of Search ..... 272/52, 52.5, 53.1, 272/53.2, 56; 297/181, 258; 280/1.177, 1.11 R, 1.13, 1.16, 1.165, 1.167, 1.175; D21/193, 247, 66, 68, 69, 70, 250

[56] References Cited

U.S. PATENT DOCUMENTS

| | | | |
|---|---|---|---|
| 1,637,500 | 8/1927 | Sherrod | 280/1.177 |
| 1,863,012 | 6/1932 | Hahs | 272/53.1 |
| 2,209,320 | 7/1940 | Cisor | 272/52.5 UX |
| 2,363,333 | 11/1944 | Johnson | 272/52.5 |
| 2,467,236 | 4/1949 | Sefton et al. | 272/53.1 X |
| 2,560,436 | 7/1951 | Green | 272/52 |
| 2,589,570 | 3/1952 | Phillips | 272/53.1 |
| 2,765,177 | 10/1956 | Hawkins | 280/1.177 |
| 3,680,857 | 8/1972 | Bonvicini et al. | 272/52 |

*Primary Examiner*—Robert A. Hafer
*Assistant Examiner*—Arnold W. Kramer
*Attorney, Agent, or Firm*—Richards, Harris, Medlock & Andrews

[57] ABSTRACT

A support (12, 28) is provided for a person to sit on the rocking device (10) to achieve a stable, but pleasing, motion. Front (18) and rear (20) leg pairs are provided for elevating the support (12, 28). Corresponding front (30) and rear (32) arcuate rocker members are provided for rotating on a surface. The rotating motion is converted to a rocking motion by eccentrically and rotatably mounting the legs (18, 20) outboard of the center of rotation of the rocker members (30, 32). Further rocking action is obtained by rotatably mounting the front (18) or rear (20) leg pairs to the support (12, 28). Rotation of the rocker members (30, 32) is synchronized by rotating tie rods (40) mounted along radials from the rotation centers for said rocker members (30, 32).

5 Claims, 4 Drawing Figures

ROCKING HORSE WITH INTERCONNECTED ROCKERS

TECHNICAL FIELD

This invention relates to rocking apparatus and, more particularly, to rocking toys which can be safely rocked by a rider mounted on the animal figure.

BACKGROUND ART

A rocking animal is a favorite toy for children. Exciting movements can be obtained based on the skill and intrepidity of the rider. A young rider can achieve an increasing skill level as a function of the rider's own growth and desires.

However, these riding toys (conventionally "rocking horses") can have points of instability or obtain sudden movements in recovering from unusual attitudes. The traditional rocking horse, for example, includes an animal body mounted above a pair of curved parallel rocker elements having only two ground contact areas. If the rocking movement becomes too large, the tipping moment can become greater than righting moment and the unit will suddenly upend.

One approach to stability is to mount the animal figure on a stationary platform. Thus, animal figures have been suspended by springs from a stationary base frame. This rocking horse can act suddenly and, on occasion, violently to input movements by the rider, even to the point of dislodging the rider.

A stabilizing improvement is to mount the animal body on lever arms pivoted from the stationary frame. Opposed synchronizing bars may be attached to the lever arms. Pivoting a lever arm then produces synchronized rotation of all the lever arms to produce controlled movement of the animal body in substantially a swinging movement. However, this movement is not believed to be esthetically or adventureously pleasing.

The disadvantages of the prior art are overcome by the present invention, however, and an improved rocking apparatus is provided for obtaining a rocking-type motion and particularly for a toy for riding by children in a safe, but exciting, manner.

SUMMARY OF THE INVENTION

In a preferred embodiment of the present invention, an animal body is mounted above front and rear pairs of opposed arcuate rockers. Animal body leg portions are fixed to axles which are eccentrically and rotatably mounted to the arcuate rockers. Movement of the front and rear pairs of rockers is synchronized by tie rods connected between the front and rear rockers.

It is a feature of the present invention to provide a stable toy riding animal having a rocking motion.

It is another feature to provide both back-and-forth and up-and-down movement using synchronized front and back rockers.

These and other features and advantages will become apparent from the following detailed description, wherein reference is made to the figures in the accompanying drawings.

DETAILED DESCRIPTION

Figure 1:
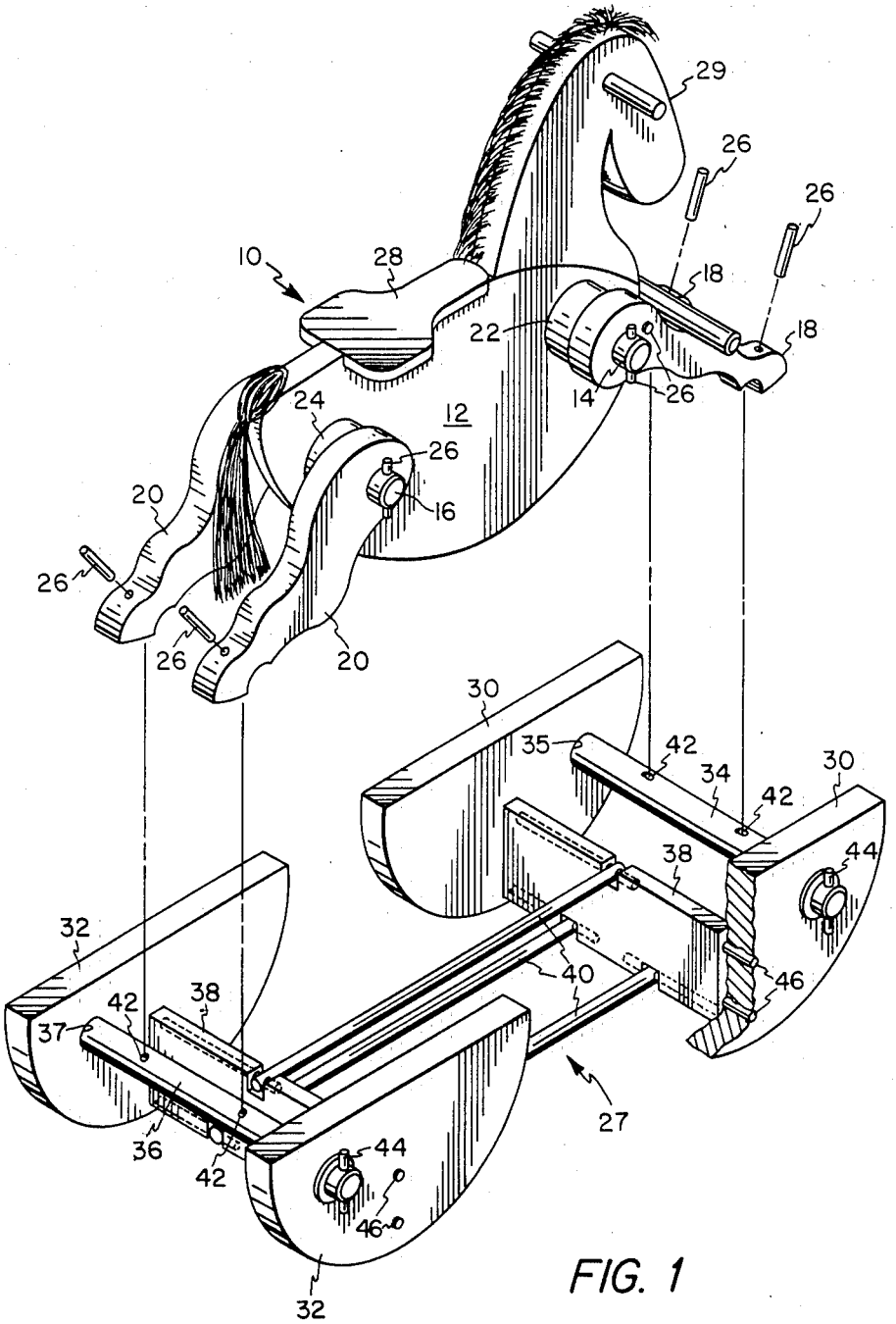
FIG. 1 is a pictorial illustration in exploded view of one embodiment of the present invention.

Referring now to FIG. 1, there may be seen a pictorial illustration and exploded view of one embodiment of the present invention. Body member 10 is preferably provided in the form of some animal, and horses have been particularly favored. Body element 12 forms the main structural member. Front support dowel 14 and rear support dowel 16 depend sideways from body 12 in both directions and are generally cylindrical to permit rotation thereabout. As herein used, "front" denotes a direction toward the head of the animal figure and "rear" denotes a direction toward the tail of the animal figure. Likewise, relative motions are determined by viewing the left side of body 12 with the forward portion on the left. Thus, "forward", "counter-clockwise" and "down" rotation all designate the same movement. Conversely, "rearward", "clockwise", and "up" rotation have the same meaning.

As shown in FIG. 1, front legs 18 and rear legs 20 are mounted on front and rear support dowels 14 and 16, respectively. Front spacer 22 and rear spacer 24 may be provided to space legs 18 and 20 apart from body 12. Pegs 26 are used to secure legs 18 and 20 and spacers 22 and 24 on support dowels 14 and 16 and permit rotation thereabout. It will be appreciated that a variety of fasteners may be used in place of pegs 26 suitable for securing rotatable parts on an axle-like member.

In one embodiment, front leg 18 is secured to spacer 22 by a peg 26 to form a fixed relationship with body 12. Rear leg 20 is permitted to rotate about rear support dowels 16, as hereinafter depicted.

Body member 12 further supports head member 29 which may be used for support of the rider and may be decorated to depict the animal form being displayed. In addition, seat 28 is fastened to body 12 by any convenient means, such as screw fasteners, to support the rider on body member 12. It is possible to form body member 12 with an integral seat 28 rather than the separate pieces depicted herein.

Animal form 10 is mounted on the rocking mechanism 27 by fastening legs 18 and 20 to axles 34 and 36, respectively. Pegs 26 may be inserted into leg mountings 42 to secure the legs to axles 34 and 36. Axles 34 and 36 are permitted to rotate as hereinafter described to accommodate various relative movements.

Rocking mechanism 27 includes front arcuate rockers 30 and rear arcuate rockers 32 which rotate about their respective centers of rotation. In a preferred embodiment, front arcuate rockers 30 and rear arcuate rockers 32 are paired semi-circular members. Front axle 34 is rotatably mounted within forward eccentric mounting 35 and rear axle 36 is rotatably mounted within rearward eccentric mounting 37. Fasteners 44, which may conveniently be pegs, secure the axles 34 and 36 within the eccentric mountings 35 and 37, respectively, while permitting rotation therein.

Eccentric mountings 35 and 37 are mounted outboard of their respective centers of rotation. As shown in FIG. 1, mountings 35 are relatively forward of the center of rotation for rockers 30. Likewise, mountings 37 are relatively rearward of the center of rotation for rockers 32, where forward and rearward are conventionally based on the orientation of body member 12.

In order to provide synchronized movement of front arcuate rockers 30 and rear arcuate rockers 32, a synchronizing mechanism is provided. A suitable synchronizing mechanism includes at least a pair of parallel rods which are pivotally mounted along a radius of an arcuate rocker member and similarly connected to another arcuate rocker member on the other end of body 12. Thus, for example, rotation of a front arcuate rocker would cause the tie rods to rotate the rear arcuate rocker through an identical angle, and vice versa. A synchronized arcuate movement thereby is obtained.

As depicted in FIG. 1, in preferred embodiment, spanner plates 38 are fastened 46 along radials from the centers of rotation for the front 30 and rear 32 arcuate rockers. In this instance, three parallel tie rods 40 are provided which transmit relative motion between front 30 and rear 32 arcuate rockers.

Figure 2:
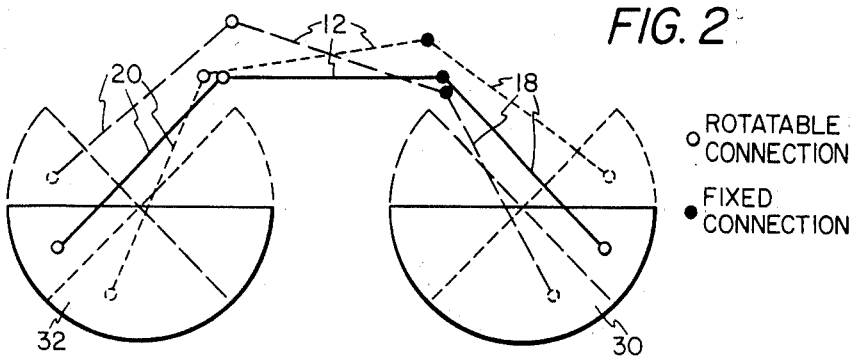
FIG. 2 is a graphic illustration of the relative movement of parts in one embodiment of the present invention.

Referring now to FIG. 2, there is depicted a graphic illustration of the relative movement of active members during synchronized rotation of front 30 and rear 32 rockers. The available relative movements between parts and the length of the parts permits a rotation of about + or −45° from the horizontal position.

In FIG. 2, there is clearly shown the up-and-down motion produced during rotation of rockers 30 and 32. It should also be appreciated that a frontward and backward movement is also produced by the rotation of rockers 30 and 32 along the ground as the ground contact point moves. This is not shown in FIG. 2 for ease of reference.

It will be appreciated from FIG. 2 that the movements are smooth and continuous. It will be further noted that these movements occur between defined limits and before instability points are reached. Further, the front 30 and rear 32 arcuate rockers, particularly where provided in paired configuration, further enhance the overall stability of the toy.

Figure 3:
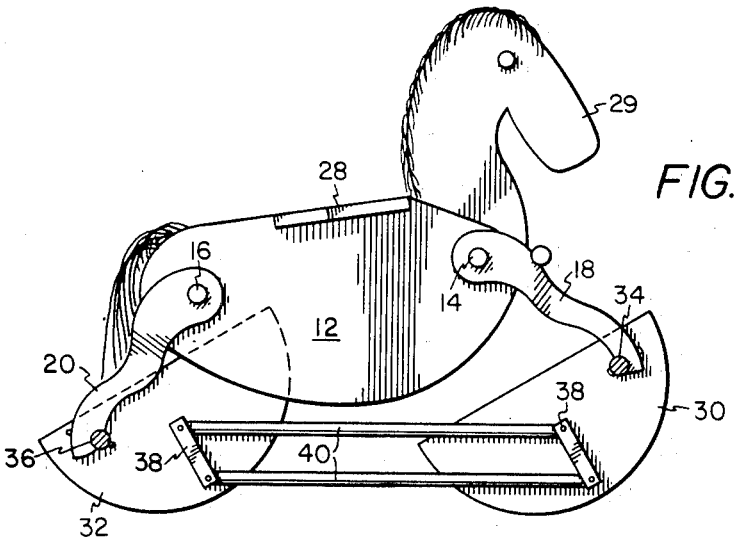
FIG. 3 is a pictorial representation of one extreme configuration illustrated in FIG. 2.

Referring now to FIG. 3, there is depicted in pictoral form an actual embodiment of a rocking toy according to the present invention. The front 30 and rear 32 arcuate rockers are rotated to a rearmost position about eccentric mountings 35 and 37, respectively. Front 34 and rear 36 axles move the legs 18 and 20 to new positions as eccentric mountings 35 and 37 rotate about 45° in a clockwise direction. Tie rods 40 assist in achieving substantially the same clockwise rotation from all arcuate rockers.

As shown in FIG. 3, rear leg 20 has rotated about rear support dowel 16 to lower the rearward part of body 12. Front leg 18 is secured against rotation about support dowel 14 to obtain the relative movements depicted in FIG. 3. Head 29 is provided and may be used for support by a rider on body 12.

Figure 4:
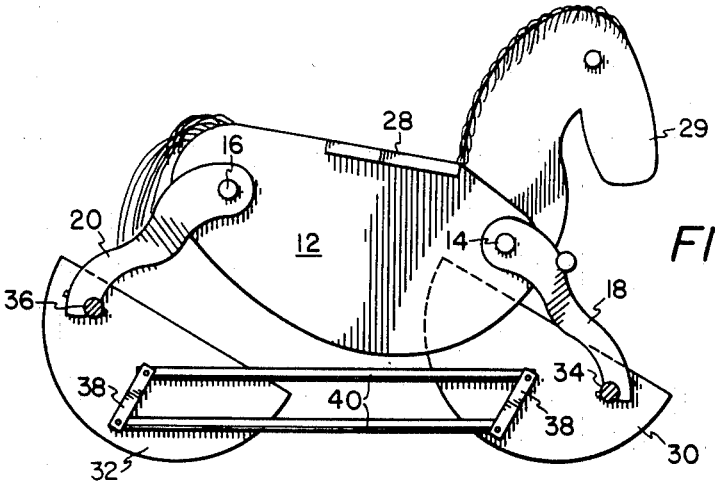
FIG. 4 is a pictorial representation of another extreme configuration illustrated in FIG. 2.

Referring now to FIG. 4, front 30 and rear 32 arcuate rockers have been rotated to a forwardmost position, about 45° in a counter-clockwise direction. Front axle 34 mounted in eccentric mounting 35 forward of the center of rotation has moved down with front leg 18. Likewise, rear axle 36 mounted within eccentric mounting 37 has moved upward with rear leg 20. Rear leg 20 has rotated about support dowel 16 to raise the rear portion of body 12 to produce an up-and-down motion. It is readily seen in comparing FIGS. 3 and 4 that the point of ground contact of arcuate rockers 30 and 32 has moved along the periphery of the rockers, resulting in a corresponding frontward-and-backward motion.

The stability of the rocking toy may be further appreciated from FIGS. 3 and 4 by observing the extremes of the backward and forward movements available to a rider while producing the controlled movements depicted in FIGS. 3 and 4. Thus, a rider is allowed to freely exercise and move the body in a simulated horse riding motion without danger of tilting forward or backward or of tipping sideways.

As many possible embodiments may be made of this invention without departing from the spirit or scope thereof, it is to be understood that all matters herein set forth and the accompanying drawings are to be interpreted as illustrative and not in any limiting sense. It will be particularly appreciated that the rocking mechanism described above may be advantageously adapted for use in other rocking devices and such adaptations are within the scope hereof.

I claim:

1. A rocking toy comprising:

a body portion for supporting a rider, front leg means fixedly connected to said body portion, rear leg means rotatably connected to said body portion, rocker means including a first circular shaped rocker member rotatably connected with said front leg means eccentric and relatively forward of the center of rotation of said first rocker member, a second circular shaped rocker member rotatably connected with said rear leg means eccentric and relatively rearward of the center of rotation of said second rocker member, and tie rod means connecting said first and second rocker members for synchronizing rotation of said first and second rocker members during movement of said rider, said tie rod means including at least two parallel tie rods each pivotally mounted a different distance along a radius of said first rocker member and pivotally connected the same different distance along a corresponding parallel radius of said second rocker member on the same side of said centers of rotation, said at least two parallel tie rods having opposed relative motion with respect to one another for said synchronizing rotation.

2. A rocking toy according to claim 1, further including front and rear axle means fixedly connecting said front and rear leg means, respectively, said front and rear axles forming said eccentric rotatable connection with said first and second rocker members, respectively.

3. Rocking apparatus having a seat supported by first and second leg pairs mounted to a rocker, wherein the improvement comprises:

a first circular shaped rocker member rotatably connected with said first leg pairs eccentric and relatively forward of the center of rotation of said first rocker member, a second circular shaped rocker member rotatably connected with said second leg pairs eccentric and relatively rearward of the center of rotation of said second rocker member, and tie rod means connecting said first and second rocker members for synchronizing rotation of said first and second rocker members, said tie rod means including at least two parallel tie rods each pivotally mounted a different distance along a radius of said first rocker member and pivotally connected the same different distance along a corresponding parallel radius of said second rocker member on the same side of said center of rotation, said at least two parallel tie rods having opposed relative motion with respect to one another for said synchronizing rotation.

4. Apparatus according to claim 3, wherein said second leg pair is rotatably connected to said seat.

5. Apparatus according to claim 3 further including first and second axles fixedly connected with said first and second leg pairs, respectively, and rotatably engaging said first and second rocker members, respectively, at said eccentric connections.

* * * * *